United States Patent [19]

Strong

[11] Patent Number: 4,691,924

[45] Date of Patent: Sep. 8, 1987

[54] GOLFER'S ARM MOVEMENT CONTROL DEVICE

[75] Inventor: Michael P. Strong, Miami, Fla.

[73] Assignee: J. B. Golf Enterprises, Inc., Birmingham, Ala.

[21] Appl. No.: 861,861

[22] Filed: May 7, 1986

[51] Int. Cl.[4] ..... A63B 69/36

[52] U.S. Cl. ..... 273/189 R; 273/DIG. 30

[58] Field of Search ..... 273/189 R, 189 A, 183 B, 273/DIG. 30, 54 B; 128/78, 134

[56] References Cited

U.S. PATENT DOCUMENTS 3,970,316 7/1976 Westmoreland ..... 273/189 R 4,359,221 11/1982 Taylor ..... 273/189 R

*Primary Examiner*—George J. Marlo

*Attorney, Agent, or Firm*—Webb, Burden, Robinson & Webb

[57] ABSTRACT

A golf training device having a first band surrounding the chest of the golfer and a second band surrounding the leading arm of the golfer. The first band has a loop pad on the outer surface adjacent each free end and a hook pad on the inner surface adjacent one free end which cooperates with one of the loop pads on the outer surface of the first band to hold the band in place on the golfer's chest. A flexible inelastic strap has one end attached to the outer surface of the first band and the other end attached to the second band. A hook pad is located on one end of the second band and cooperates with a loop pad on the outer surface of the first band to attach the end of the second band to the first band so that the second band surrounds the leading arm of the golfer to restrain the leading arm and to thereby control the golfer's swing.

6 Claims, 4 Drawing Figures

GOLFER'S ARM MOVEMENT CONTROL DEVICE

BACKGROUND OF THE INVENTION

This invention relates generally to training devices for improving a golfer's swing and more particularly to a device which controls the golfer's arm motion during a golf swing by restricting the movement of the arm relative to the golfer's body.

The relationship between a golfer's leading arm and body during a golf swing is fundamental to a proper stroke. If the arc and plane of the swing is incorrect, a fair or poor shot will result. If the swing is correct, the result will usually be a good shot.

Many training aids have been suggested for controlling the movement of a golfer'head, arms, legs and body. Specific devices for controlling the movement of a golfer's arms are shown and described in U.S. Pat. Nos. 1,655,092; 1,699,219; 2,093,153; 2,450,162; 2,773,691; 2,808,267; 3,419,277; 3,679,214; 3,970,316 and 4,061,340 and British Pat. Nos. 20,463 and 180,599. All of these patents are addressed to devices for restraining one or both arms of a golfer during a golf swing.

The present invention is a distinct improvement over the training devices of the prior art as will become more apparent from the following specification.

SUMMARY OF THE INVENTION

The golf swing training device, according to the invention, comprises a pair of bands which are connected to one another. A first band includes an elastic section and is adapted to encircle the chest of a golfer. One end of the first band includes a pad of hooks which are adapted for connection with an elongated pad of loops mounted on the other end of the first band. The pad of hooks and the pad of loops form a Velcro fastener. A loop, preferably made of vinyl material with an internal boning of a stiff material such as aluminum, is carried on the first band between the elastic section and the pad of hooks.

A second inelastic band is attached to the first band by a flexible inelastic strap which is sewed to the outside surface of the first band with a reinforcement webbing and to the outside of the second band. The second band is adapted to encircle the golfer's arm and includes a portion forming a protector strip which extends from the joinder of the second band and the flexible inelastic strap outwardly in a direction opposite to the direction of the loop on the first band as the second band encircles the golfer's arm. This portion of the second band acts as a cushion for the golfer's lead arm. A second portion of the second band extends from the joinder of the band with the flexible inelastic strap and terminates in an end having a pad of hooks attached to the inner surface thereof. The second portion of the second band is adapted to encircle the golfer's arm and overlie a portion of the protector strip, pass through the loop on the first band and connect to an elongated pad of loops on the outside surface of the first band at the end of the first band carrying the pad of hooks. The second portion of the second band functions as an arm restraining portion to restrain the movement of the golfer's lead arm relative to the golfer's body.

In use, the first band is extended around the golfer's body and adjusted until it is comfortably snug. The Velcro fastener is then engaged. The protector strip is wrapped about the golfer's lead arm and the second band is drawn around the golfer's arm over the protector strip through the loop on the first band and adjusted until it is comfortably snug. The Velcro fastener is then engaged. In this condition, the golfer's lead arm is positioned close to the body, but some slight mobility remains because of the flexible inelastic strip attaching the first and second bands permitting the golfer to swing a club naturally in the proper arc and plane.

The swing connector can be used by both male and female golfers, either right or left-handed. The device can be easily applied and removed. It is relatively inexpensive to manufacture and is completely portable.

The invention will be more fully understood with reference to the accompanying drawings.

DESCRIPTION OF THE PREFERRED EMBODIMENT

Figure 1:
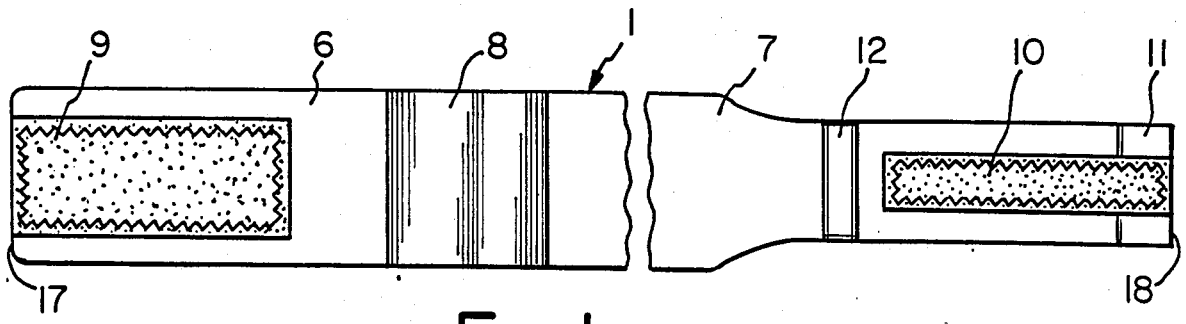
FIG. 1 is a view of the outside of the first band.
Figure 2:
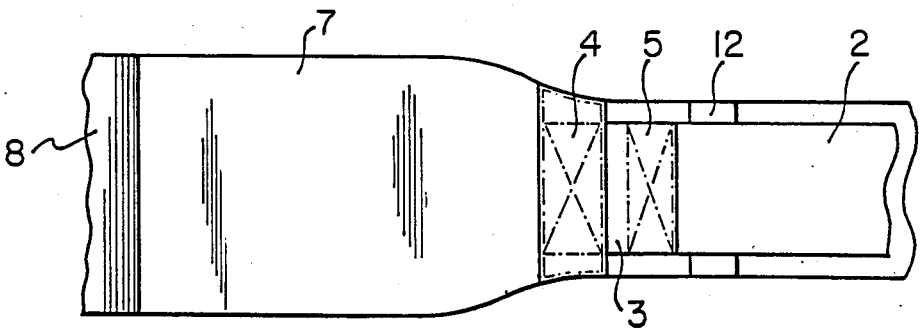
FIG. 2 is a view of a portion of the outside of the first band with the second band attached thereto; and the protector strip not shown
Figure 3:
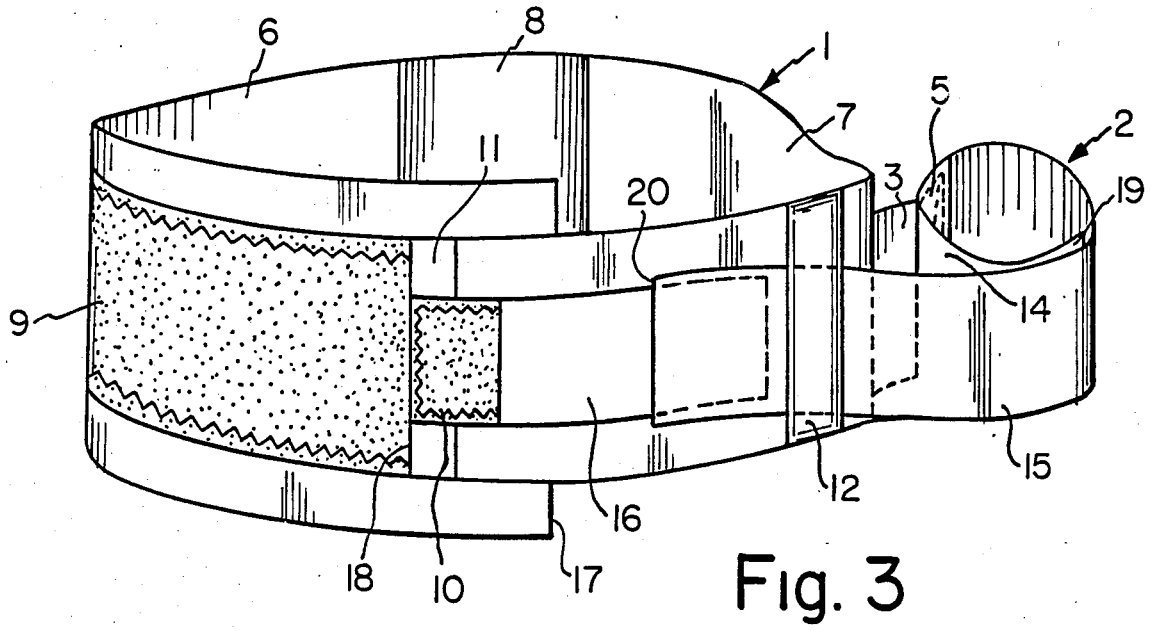
FIG. 3 is a perspective view showing the ends of the first band attached and one end of the second band attached to the first band.
Figure 4:
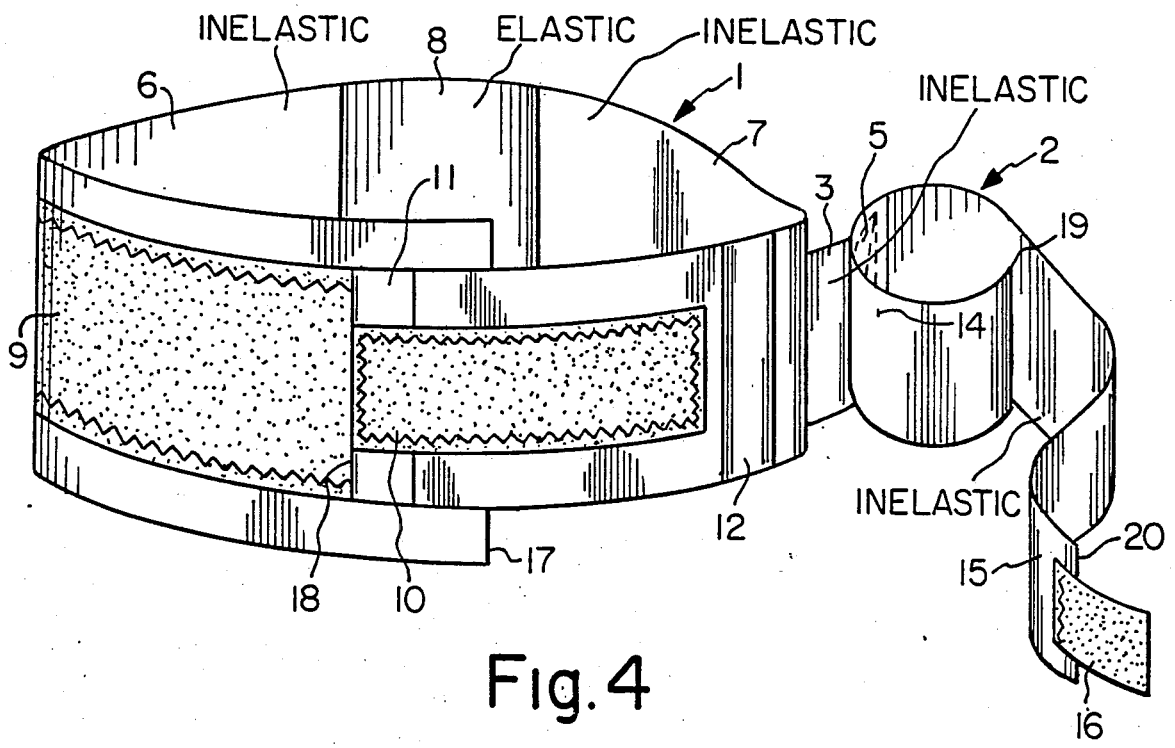
FIG. 4 is a perspective view similar to FIG. 3 with the arm restraining portion of the second band disconnected from the first band.

With reference to the drawings, it will be seen that the training device consists of a first band 1 and a second inelastic band 2 which is attached to band 1 by a short flexible inelastic strap 3 which has a first end stitched to the outer surface of band 1 with a reinforcing webbing 4 as shown in FIG. 2 of the drawings and to the outer surface of band 2 with stitching 5. The band 1 is divided into a first part 6 and a second part 7, which parts are joined together by a section 8 of an elastic material which permits the first band to fit snugly about the body of a golfer.

The outside surface of part 6 of the first band has an elongated Velcro loop pad 9 attached thereto adjacent the free end 17, and the outside surface of the second part 7 has an elongated Velcro loop pad 10 attached thereto adjacent the free end 18. The free end of the second part 7 of the first band has a Velcro hook pad 11 attached to the inner surface which is adapted to cooperate with loop pad 9 to hold the first band in place around a golfer's chest. A loop 12 is stitched to the second part 7 of the first band 1 and is provided with boning, such as aluminum, so that the loop is rigid.

The second end of flexible inelastic strap 3 is stitched to the outside of the second band 2 so that the second band is connected to but spaced from the first band. The second band 2 includes a protector strip 14 having a free end 19 which extends in one direction from stitching 5 to surround a portion of the golfer's arm when the band is in use and an elongated restraining portion 15 which extends in the opposite direction from stitching 5. The free end 20 of elongated portion 15 carries a Velcro hook pad 16 on the inner surface which is adapted to be connected to the Velcro loop pad 10 on the outside surface of the second section 7 of the first band 1.

When the training device is in use, the first band 1 is placed around the golfer's chest, and the Velcro hook pad 11 adjacent free end 18 is attached to the Velcro loop pad 9 adjacent free end 17 to firmly attach the two ends of the first band. The elastic section 8 provides for a snug fit of the first band around the golfer's chest without interfering with breathing or with the movement of the golfer's body. The second band 2 surrounds the golfer's leading arm with the protector strip 14 surrounding a substantial part of the arm. The elongated portion 15 of band 2 is wrapped around the arm to overlie the protector strip or cushion 14 and is passed through the loop 12 parallel to the outside surface of the first band. The Velcro hook pad 16 on the end 20 of elongated portion 15 of the second band is then attached to the Velcro loop pad 10 on the outer surface of the second part 7 of the first band 1 to restrain the movement of the golfer's leading arm relative to the golfer's body. Because of the inelastic strap 3, the inelastic second band 2 and the elongated Velcro loop pad 10, which is attached to the outside surface of the second part 7 of the first band 1, the second band can be adjusted through a large range of sizes to accommodate golfers having different size arms and to draw the arm into a tight yet movable position relative to the golfer's body.

When the second band is attached to the outer surface of the first band, the golfer's leading arm is held in the proper position relative to the golfer's body so as to require that when the golfer swings a club, the club head travels through the proper arc and the club head and shaft are moved in the proper plane to maximize the efficiency of the golf stroke. The advantages of the swing connector training device are an improved swing resulting in an improved golf game with consequent lower scores.

While I have shown and described Velcro fasteners for connecting the end of the first strap and connecting the end of the second strap to the outside surface of the first strap, it will be understood by those skilled in the art that other fasteners, such as snaps, buttons, etc., may be utilized with equal facility.

While a preferred embodiment of the invention has been described herein, it is to be understood that the invention may be embodied within the scope of the appended claims.

What is claimed is:

1. A golf training device having a first band (1) adapted to surround the chest of a golfer and an inelastic second band (2) adapted to surround and restrain the lead arm of a golfer, said first band (1) having a first part (6) with a free end (17) and a second part (7) with a free end (18), attachment means (9) on the outer surface of said first part (6) adjacent said free end (17) for attaching said free end (17) of said first part (6) to said free end (18) of said second part (7), first attachment means (11) on the inner surface of said second part (7) adjacent said free end (18) for attachment with said attachment means (9) on the outer surface of said first part (6) to connect said free end (17) of said first part (6) with said free end (18) of said second part (7), second attachment means (10) on the outer surface of said second part (7) adjacent said free end (18) of said second part (7), a flexible inelastic strap (3) having a first end and a second end, said first end of said flexible inelastic strap (3) attached (4) to the outer surface of said second part (7) of said first band (1) intermediate the ends of said second part (7), said second end of said inelastic strap (3) attached (5) to said second band (2) intermediate the ends (19 & 20) of said second band (2) and attachment means (16) on the inner surface of said second band (7) adjacent one end (20) of said second band (7) for attaching said one end (20) of said second band (2) to said second attachment means (10) on the outer surface of said second part (7) of said first band (1), whereby said second band (2) contacts the lead arm of a golfer to restrain the movement of the lead arm of a golfer relative to the golfer's body and thereby control the golfer's swing.

2. A golf training device as set forth in claim 1 wherein said first band (1) includes an elastic section (8) intermediate said first part (6) and said second part (7).

3. A golf training device as set forth in claim 1, wherein one portion (14) of said second band (2) is a cushion section adapted to overlie a part of the golfer's arm and the other portion (15) is an arm restraining portion adapted to overlie said cushion section (14) and carrying said attachment means (16) on the inner surface of said second band (7) for attaching said one end (20) of said second band (2) to said second attachment means (10) on the outer surface of said second part (7) of said first band (1) adjacent said free end (18) of said second part (7).

4. A golf training device as set forth in claim 1 including a boned loop (12) attached to the outer surface of said second part (7) of said first band (1) adjacent said second attachment means (10) on the outer surface of said second part (7) of said first band (1), whereby said one end (20) of said second band (2) carrying said attachment means (16) passes between the outer surface of said second part (7) of said first band (1) and the inner surface of said loop (12) to increase the stability of the contact between said second band (2) and the golfer's lead arm.

5. A golf training device as set forth in claim 1 wherein said attachment means (9) on the outer surface of said first part (6) of said first band (1) and said second attachment means (10) on the outer surface of said second part (7) of said first band (1) are loop pads and said first attachment means (11) on the inner surface of said second part (7) of said first band (1) and said attachment means (16) on the inner surface of said second band (2) are hook pads.

6. A golf training device having a first band (1) adapted to surround the chest of a golfer and a second inelastic band (2) adapted to surround and restrain the lead arm of a golfer, said first band (1) having a first end (17) with attachment means (9) on the outer surface adjacent said first end (17) and a second end (18) with first attachment means (11) on the inner surface adjacent said second end (18) for attaching said second end (18) of said first band with said attachment means (9) on the outer surface of said first band (1) adjacent said first end (17) of said first band and second attachment means (10) on the outer surface of said first band (1) adjacent said second end (18), a flexible inelastic strap (3) having a first end attached (4) to the outer surface of said first band (1) intermediate said first and second ends (17 & 18) of said first band (1) and a second end attached (5) to said second band (2) intermediate the ends (19 & 20) of said second band (2) and attachment means (16) on one end (20) of said second band (7) for attaching one end (20) of said second band (2) with said second attachment means (10) on the outer surface of said first band (1), whereby said second band (2) contacts the lead arm of a golfer to restrain the lead arm and control the golfer's swing.

* * * * *